United States Patent [19]

Fehlmann et al.

[11] Patent Number: 4,763,631

[45] Date of Patent: Aug. 16, 1988

[54] FUEL INJECTION PUMP FOR INTERNAL COMBUSTION ENGINES

[75] Inventors: Wolfgang Fehlmann, Stuttgart; Gerald Hofer, Bad Aibling; Dieter Junger; Gerhard Stumpp, both of Stuttgart, all of Fed. Rep. of Germany

[73] Assignee: Robert Bosch GmbH, Stuttgart, Fed. Rep. of Germany

[21] Appl. No.: 134,113

[22] Filed: Dec. 17, 1987

[30] Foreign Application Priority Data

Dec. 23, 1986 [DE] Fed. Rep. of Germany ..... 3644147

[51] Int. Cl.[4] ..... F02M 39/00

[52] U.S. Cl. ..... 123/503; 123/449; 123/496

[58] Field of Search ..... 123/503, 449, 373, 501, 123/500, 496; 417/500, 492

[56] References Cited

U.S. PATENT DOCUMENTS

| | | | |
|---|---|---|---|
| 4,220,128 | 9/1980 | Kobayashi | 123/449 |
| 4,409,939 | 10/1983 | Eheim | 123/449 |
| 4,413,600 | 11/1983 | Yanagawa | 123/449 |
| 4,635,605 | 1/1987 | Faupel | 123/449 |
| 4,649,883 | 3/1987 | Bohringer | 123/449 |
| 4,711,221 | 12/1987 | Laufer | 123/496 |
| 4,718,385 | 1/1988 | Konrath | 123/503 |

FOREIGN PATENT DOCUMENTS

| | | | |
|---|---|---|---|
| 0102420 | 8/1979 | Japan | 123/449 |
| 0126828 | 10/1979 | Japan | 123/503 |
| 0075953 | 6/1981 | Japan | 123/503 |
| 488423 | 1/1976 | U.S.S.R. | 123/449 |

*Primary Examiner*—Carl Stuart Miller

*Attorney, Agent, or Firm*—Edwin E. Greigg

[57] ABSTRACT

A fuel injection pump of the distributor type in which to attain low injection rates in the idling range, longitudinal slits or longitudinal conduits are provided in the jacket face of the pump piston in accordance with the number of supply strokes of the pump piston. The slits or conduits are in continuous communication with an annular groove and the adjoining annular slide which is the quantity adjusting device of the fuel injection pump. The slits on conduits come in turn into communication with a control opening during the supply stroke of the pump piston via which opening the pump work chamber can be relieved whenever in the course of the pump piston stroke movement a second outlet opening of a relief conduit extending in the pump piston and communicating with the pump work chamber, comes into communication with the annular groove. From this point on, in order to attain quiet idling of the engine, the supply rate of the pump piston is reduced by the outflow rate, determined by a throttle of the pumped fuel into the suction chamber. By rotating the annular slide relative to the pump piston, the control opening can be moved out of the operating range of the longitudinal conduits and the quiet-idle device is shut off.

21 Claims, 4 Drawing Sheets

FUEL INJECTION PUMP FOR INTERNAL COMBUSTION ENGINES

BACKGROUND OF THE INVENTION

The invention is based on a fuel injection pump for internal combustion engines. In a fuel injection pump known from German Offenlegungsschrift No. 32 13 724, the pump piston has as its relief conduit an axial blind bore originating at the pump work chamber, from which bore a transverse conduit branches off to two first outlet openings, and a radial conduit also branches off to a second outlet opening. This outlet opening is offset with respect to the first outlet openings toward the pump drive side and cooperates with a radial bore, which is disposed in the annular slide and by way of which the communication with the relief chamber can be established. In the known fuel injection pump the radial bore is disposed such that, at an annular slide position corresponding to the low-load operating range during the pump piston supply stroke, the second outlet opening is in communication with the radial bore, while in the full-load range, the second outlet opening does not come to communicate with the radial bore. This apparatus serves to allow only some of the supply strokes of the pump piston to be effective in the low-load range; accordingly, a plurality of radial bores are provided, distributed around the annular slide, so that only every other pump piston supply stroke, for instance, leads to a pressure buildup in the pump work chamber and hence to the injection of fuel. Correspondingly, only half of the cylinders of the internal combustion engine serve to drive the engine. This provision is meant to lower fuel consumption in the partial-load range.

A fuel injection pump is also known from German Offenlegungsschrift No. 32 18 275, in which instead of the radial bores in the annular slide provided in the above-described known fuel injection pump, diametrically extending grooves originating at the end face of the annular slide are provided, which now cooperate with only a single outlet opening of the relief conduit. The annular slide here is not only axially displaceable on the pump piston as a function of the adjustment of a fuel injection quantity regulator, but is also rotatable by a torque device. By means of rotation, during the supply stroke of the pump piston, the outlet opening can be made to come into communication with one of the diametrically extending grooves in alternation, upon every supply stroke, or every other supply stroke, of the pump piston, depending on the number of grooves provided. Thus, either the number of injections can be reduced by half, for example, similarly to what is known from the prior art described initially above, or the high-pressure supply of the fuel injection pump can be suppressed entirely. Furthermore, by reducing the width of the grooves, it is possible merely to throttle the outflow or "leakage" of fuel during a particular supply stroke, which is intended to function so as to reduce the fuel injection rate in the lower rpm range. This has the effect that the engine can be operated during idling, for example, with reduced combustion noise.

In this known fuel injection pump, problems arise, however, in terms of controlling the quantity of fuel flowing out via the throttle cross sections. In particular, it is problematic to increase the fuel quantity continuously from the transition out of the idling range to the partial-load range, to prevent a load jump upon load take-up. In particular, the outflow of the fuel quantity is dependent, in the known apparatus, on the rpm; that is, it decreases with increasing rpm, because here the throttling action increases together with the decreasing time in throttle cross section. Problems also arise if the fuel injection pump has an associated injection onset adjusting device, which typically means that the first outlet opening is adjusted relative to the drive shaft rotational position of the fuel injection pump.

OBJECT AND SUMMARY OF THE INVENTION

The fuel injection pump according to the invention has the advantage over the prior art that changing the axial position of the annular slide, at a rotational position thereof corresponding to idling or low partial load, changes the stroke beyond which, after the pump piston supply stroke onset, the second outlet opening comes into communication with the control opening. Over the course of this stroke, the fuel is pumped without "leakage". Upon load takeup during engine starting, the proportion of the pump piston supply stroke that pumps without "leakage" through the second outlet opening can thus be increased continuously. This makes a load takeup possible, without bucking, in the idling range.

An advantageous feature of the invention provides that in the transition from idling to the partialload range, "leakage" of fuel via the second outlet opening during the supply stroke of the pump piston can be shut off. By providing longitudinal conduits, the free cross section at the control point is reduced continuously, once again enabling a smooth transition, without bucking, between idling and partial-load operation. Alternative ways of disposing the longitudinal conduits in cooperation with the control opening are also disclosed. Other advantageous features produce a continuous automatic shutoff of the quiet-idle device or leakage through the second outlet opening at load takeup or when higher torque is desired and input by the driver of the motor vehicle that is driven by the engine equipped with the fuel injection pump according to the invention. This fuel injection pump is equipped with a conventional fuel injection quantity regulator, operating with a governor spring, as defined hereinafter.

A rotary magnet device, which is triggered by the electric control unit, is advantageously used for adjusting the annular slide in both the axial and rotational direction. In a particularly advantageous feature of the invention, with a single control magnet as defined hereinafter, the fuel injection quantity in the partial-load to full-load range can be adjusted exactly, operation with the quiet-idle device according to the invention in the idling or low partial-load range becomes possible, and a shutoff of the quiet-idle device upon load takeup can be attained, This has the particular advantage that during idling, at minimum load, a low injection rate is effected at injection onset by means of the leakage process via the second outlet opening, and then, as soon as the control opening moves out of coincidence with one of the longitudinal conduit, this rate changes to a higher pumping rate. At load takeup, the portion having the higher pumping rate is then located at the end of the supply stroke each time, so that an injection characteristic is obtained at which the fuel is supplied to the injection locations initially at a low injection rate and then at a higher injection rate. This promotes the course of combustion and reduces noise. Because of this injection behavior, the pre-stored fuel injection quantity is reduced still further during the injection delay.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
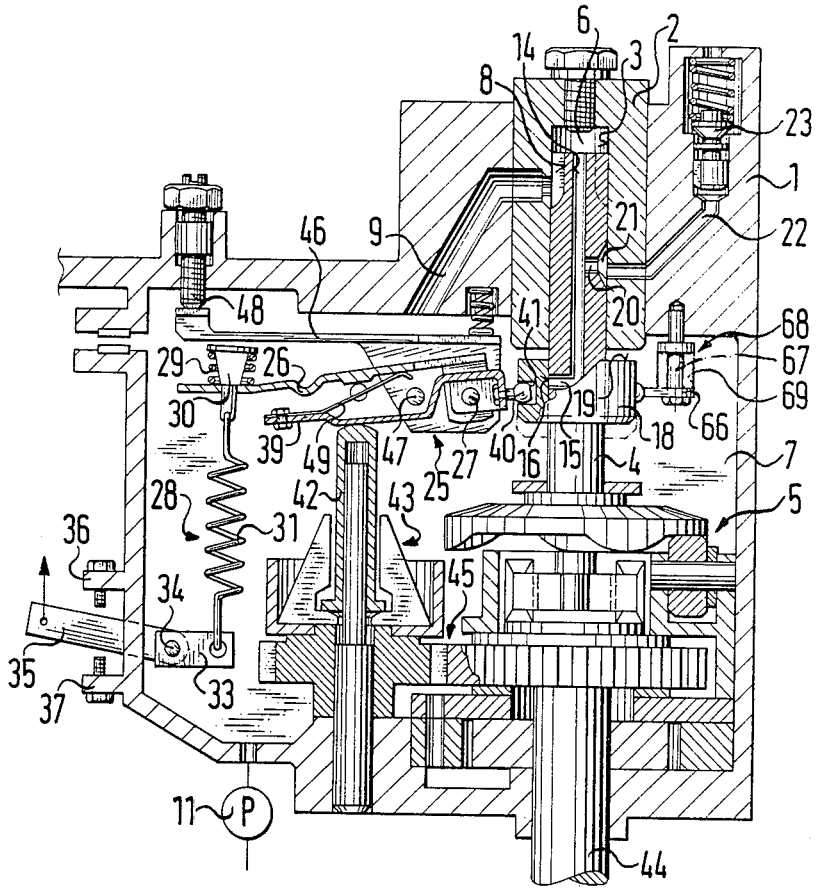
FIG. 1 shows a first exemplary embodiment, in the form of a fuel injection pump shown in simplified fashion in longitudinal section.

A bushing 2 is disposed in a housing 1 of a fuel injection pump shown in FIG. 1. In the inner bore 3 of this bushing 2, a pump cylinder is formed, a pump piston 4 executes a simultaneously reciprocating and rotating motion, driven by a cam drive 5. On one face end, the pump piston encloses a pump work chamber 6 and includes an end portion that protrudes partway out of the inner bore 3 into a pump suction chamber 7, which is enclosed in the housing 1.

The pump work chamber 6 is supplied with fuel, via longitudinal grooves 8 disposed in the jacket face of the pump piston and via a suction bore 9 that originates at the pump suction chamber 7, passes radially through the bushing 2 and extends within the housing 1, as long as the pump piston is executing its intake stroke or assumes its bottom dead center position. The pump suction chamber is supplied with fuel from a fuel tank, not shown here, via a feed pump 11. By means of a pressure control valve, not shown, the pressure is typically controlled in accordance with rpm in the successtion chamber, so as to enable making an rpm-dependent injection adjustment, for example hydraulically, via a pressure control as a function of rpm. With increasing rpm, the stroke onset of the pump piston is adjusted to "early" in a known manner.

In the pump piston, a longitudinal conduit 14, which is embodied as a blind bore and serves as a relief conduit, leads away from the pump work chamber 6. Branching off from the conduit is a transverse bore 15, which leads to a first outlet opening 16 on the circumference of the pump piston 4, into a region in which the pump piston protrudes into the suction chamber 7. The outlet openings 16 are preferably diametrically opposite one another, which leads to a balanced hydraulic load on the pump piston. Disposed on the pump piston in this region is a quantity adjusting device in the form of an annular slide 18, which is tightly slidable and rotationable on the pump piston and with its upper face end forms a first control edge 19, by means of which the first outlet openings 16 are controlled.

Also branching off from the relief conduit 14, which preferably extends coaxially with the pump piston axis, is a radial bore 20, which leads to a distributor opening 21 on the circumference of the pump piston. In the operating region of this distributor opening, feed lines 22 branch off from the inner bore 3 in a radial plane, which are distributed on the circumference of the inner bore 3 in accordance with the number of cylinders of the associated engine that are to be supplied with fuel. The feed lines lead via one valve 23 each, which is embodied in a known manner as a check valve or pressure relief valve, to the fuel injection locations, not shown. As soon as the suction bore 9 is closed by the jacket face of the pump piston, at the onset of the supply stroke of the pump piston following a corresponding rotation of the pump pisoton, the fuel located in the pump work chamber 6 is pumped to these injection locations via the relief conduit 14, the radial bore 20 and the distributor groove 21. This pumping is interrupted whenever the first outlet openings 16, in the course of the pump piston stroke, are opened by the control edge 19 and come into communication with the suction chamber 7. From that point on, the remaining fuel positively displaced by the pump piston is pumped only into the suction chamber. The higher the level at which the annular slide 18 is adjusted toward the pump work chamber, the greater the quantity of fuel pumped by the pump piston.

The fuel injection quantity regulator 25 provided for the adjustment of the annular slide has a tensioning lever 26, which is pivotable about a shaft 27, and has one arm coupled at its lever arm end to a governor spring assembly 28. This assembly comprises an idling spring 29 disposed betweeen the head of a coupling element 30 and the tensioning lever; the coupling element 30 passes through an opening in the tensioning lever, and at its other end, remote from the head, it is connected to a main governor spring 31. The main governor spring 31, in turn, is suspended at one end from a pivot arm 33, which is adjustable with an adjusting lever 35, via a shaft 34 passed through the pump housing. The adjusting lever is arbitrarily actuatable between an adjustable full-load stop 36 and an adjustable idling stop 37 by a person operating it. For instance, the adjusting lever 35 is connected to the gas pedal, which the driver of the motor vehicle equipped with the engine and fuel injection pump actuates in accordance with the torque he selects. Instead of the simple helical spring shown here as the main governor spring, it is naturally also possible to use other governor spring assemblies that are of the multi-stage and/or pre-stressed type.

A starting lever 39 is also pivotable about the shaft 27; it is two-armed, and with one arm coupled to the annular slide, via a ball head 40 engaging a transverse groove 41 extending in a radial plane to the annular slide. The other arm of the starting lever has a leaf spring 49, which as the starting spring is braced against the tensioning lever 26, thereby spreading the starting lever from the tensing lever. Acting upon this particular lever arm of the starting lever 39 is the final control element 42 of an rpm transducer in the form of a flyweight control assembly 43 of a known type, which is driven synchronously with the drive shaft 44 of the fuel injection pump, via a gear train 45. With increasing rpm, the final control element 42, along with the starting lever 39 and the annular slide 18, is accordingly displaced counter to the force of the starting spring 49, until the starting spring comes to rest on the tensioning lever 26. In the course of this movement, the annular slide is adjusted away from a highest position, nearest the pump work chamber and corresponding to a starting quantity setting, toward the pump piston drive side, thus reducing the increased starting quantity. Once the starting lever comes to rest on the tensioning lever, both levers become pivotable counter to the force of the idling spring 29, until the main governor spring 31 comes into action, adjacent the idling range. Depending upon the embodiment of main governor spring, as either a variable- speed governor spring or a minimum-maximum-speed governor spring, the tensioning lever is moved onward upon reaching the set rpm, and the annular slide 18 is displaced in order to reduce the injection quantity. in other words, a greater or lesser quantity of fuel is injected at a given rpm, depending on the position of the adjusting lever 35.

For adjustment, the shaft 27 is supported on an adjusting lever 46, which is pivotable about a shaft 47 attached to the housing and is kept in contact with an adjustable stop 48 by a spring force.

Figure 2:
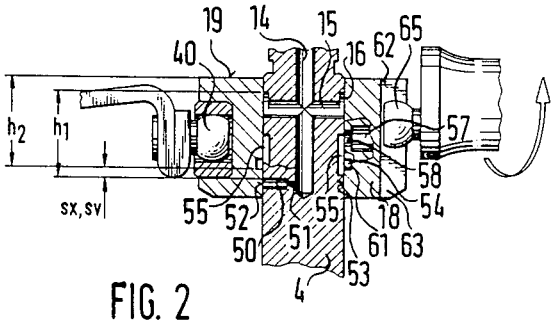
FIG. 2 is a section taken through the pump piston of the exemplary embodiment of FIG. 1, illustrating the embodiment according to the invention of the pump piston and annular slide.
Figure 5:
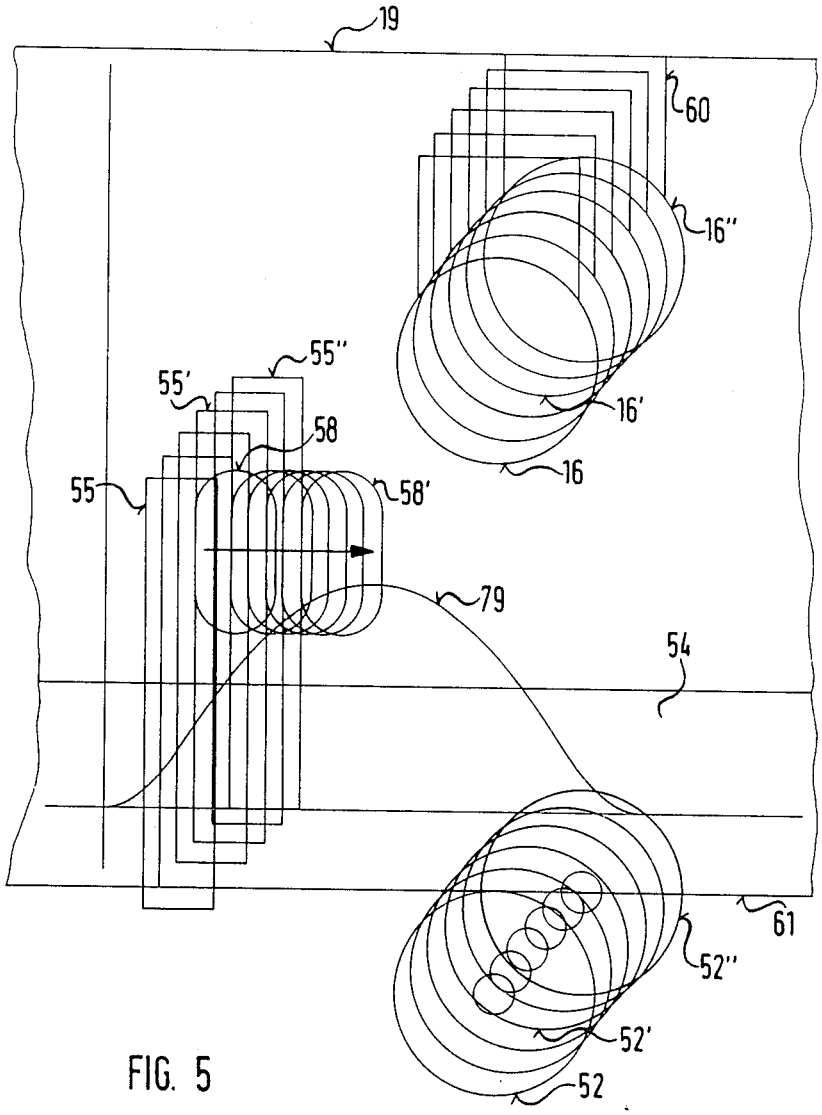
FIG. 5 shows a bent-over portion of the pump piston jacket face in the vicinity of the part of the pump piston that is effective in control, with associated control openings of the annular slide of FIG. 2, which is displaceable on this part.

To the extent described thus far, the fuel injection pump is equivalent to a standard, known version. In FIG. 2, the further development in accordance with the invention is now shown for a first exemplary embodiment of the invention, which comprises the following: The longitudinal relief conduit 14 in the pump piston extends beyond the outlet of the transverse bore 15 toward the pump piston drive end, as shown in FIG. 2, to a radial conduit 50, in which a throttle 51 is disposed. With the outlet opening of the radial conduit 51, a second outlet opening 52 is defined at the circumference of the pump piston. Between it and the first outlet openings 16 isolated longitudinal grooves 55 are provided, which are located in a plane that is radial to the pump piston axis which together with the jacket face of the inner bore 53 of the annular slide 18 sliding on the jacket of the pump piston form longitudinal conduits. The longitudinal grooves 55 may also be embodied as longitudinal slits, and in that case they also replace the throttle 51 at the same time. An annular groove 54 is also disposed on the annular slide, originating at the jacket face of the inner bore. Finally, between the control edge 19 of the annular slide and the annular groove 54 in the annular slide, a conduit 57 is provided, which extends radially and connects the inner bore 53 with the outer circumference of the annular slide. At the transition to the inner bore 53, the conduit 57 is embodied as a control opening 58, which for instance, as shown in FIG. 5, may take the form of an oblong slot extending in the axial direction. In the exemplary embodiment, as also shown in FIG. 5, the outlet openings 16 initially have the circular cross section of the transverse bore outlet face, and attached to it have a rectangular recess 60, with a limiting edge parallel to and oriented toward the control edge 19. This embodiment serves in a known manner to open up relief cross sections rapidly. The longitudinal conduits 55 are disposed such that they remain in communication with the annular groove 54 during the entire pump piston stroke. Similarly, the control opening 58 is disposed such that the radial plane into which it discharges likewise remains in coincidence with the ends of the longitudinal conduits 55 remote from the annular groove 54 over the entire pump piston stroke. The dimensioning of the axial distance hl between the second outlet opening and the first outlet opening is also such that it is shorter than the axial distance h2 between the first control edge 19 and the limiting edge 61, toward the pump drive side, of the annular groove 54. From the difference between these two axial distances, a useful leakage path $h_L$ is obtained, which at the same time is the difference represented by the possible useful stroke hn minus a prestressing stroke Sx. These dimensions play a role, to be explained in further detail hereinafter, in connection with the mode of operation of the fuel injection pump in quiet-idle operation.

Figure 4:
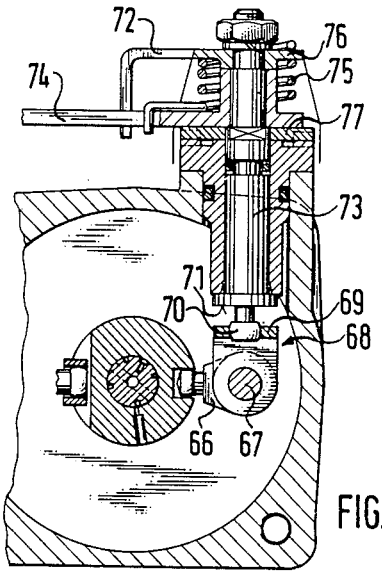
FIG. 4 illustrates the rotational drive of the annular slide, with the aid of a section taken through the fuel injection pump at right angles to the pump piston axis.

In its outer jacket face, the annular slide also has a longitudinal groove 62, extending in the axial direction, that has guide faces 63 oriented in the circumferential direction. The longitudinal groove 62 is engaged by a sliding element 65, which is gripped by the limiting faces or guide faces 63 of the longitudinal groove 62. The sliding element is pivotable in the circumferential direction of the annular slide 18 by an adjusting lever 66. The adjusting lever, as shown in FIG. 4, is part of a bell crank 68 that is pivotable about a shaft 67 and the other lever arm 69 which is engaged by a positioning prong 70. The positioning prong 70 is mounted eccentrically on the face end 71 of a shaft 73 guided out of the pump suction chamber 7 tightly through the housing to the outside. One the end of the shaft that protrudes outward, a control lever 74 is rotatably supported, being rotatable via a pre-stressed driving spring 75, in the form of a helical spring, and driving element 76, which is connected to the shaft 73 at its end in a manner such that the shaft 73 and the element 76 do not rotate relative to one another. The driving element has an arm 72, against which the contro lever 74 is held under the influence of the driving spring 75 and thus is coupled with the shaft 73. With the aid of a limiting stop 77, connected to the shaft 73, the rotation is effected only within a predetermined angular range, so that upon actuation of the control lever 74 beyond this angular range, the control lever 74 lifts away from the arm 72 and is rotated onward only under the pre-stressing of the driving spring, without movement of the shaft 73.

By means of the above-described torque device, the annular slide 18 can be rotated beginning with the sliding element 65 as far as the control lever 74, without a change in the axial position of the first control edge; in particular, this is because the transverse groove 41 extends parallel to the first control edge 19. Similarly, during an axial adjustment of the annular slide 18 by the ball head 40, the rotational position of the annular slide does not change, because the groove 62 extends in the axial direction.

Figure 6:
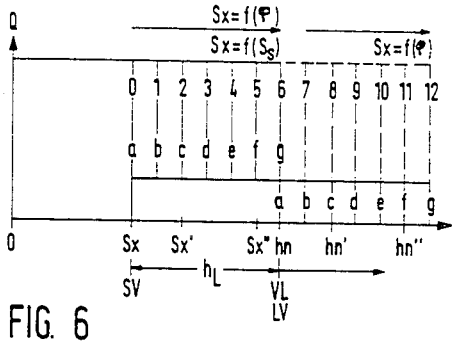
FIG. 6 is a diagram plotting the quantity of fuel attaining injection over the stroke of the pump piston, at various load positions of the annular slide.

In its specialized embodiment for attaining quiet idling, the fuel injection pump functions as follows:

If the engine is idling after the starting process has ended, then the fuel quantity regulation is controlled by means of the idling spring. Basically, after each preceding intake stroke, in which the pump work chamber is filled with fuel in a known manner, the pump piston executes a stroke of magnitude sv, until the second outlet opening 52 comes into communication with the annular groove 54. The first outlet openings are closed in accordance with the dimensions h1, h2 by the jacket face of the inner bore 53 of the annular slide. During this stroke sv, the quantity of fuel pumped by the pump piston is utilized to generate the injection pressure in the pump work chamber,. This stoke is also known as the relief stroke, and it occupies a relatively large portion of the total stroke of the pump piston, as FIG. 6 shows. From the stroke sv onward, an injection can accordingly take place, because the distributor groove 21 is in communication with one of the distributor lines 22, and a pressure that is equivalent to the opening pressure of the injection valve is attained. Now, however, if the second outlet opening is in communication with the annular groove 54, then fuel can flow out to the suction chamber 7 via one of the longitudinal conduits 55 and the control opening 58 via the conduit 57. The outflow rate is determined by the throttle 51, which can also be embodied by a reduced cross section at any point in the connection between the pump work chamber past the branching off of the radial bore 20 and relief chamber. For the sake of a small idle volume, however, the location of the throttle 51 described herein is advantageous. The outflow occurs only whenever the annular slide is in a rotational position that allows coincidence of one of the longitudinal conduits 55 with the control opening 58. The longitudinal conduits 55 are distributed around the circumference of the pump piston in accordance with the number of supply strokes executed per rotation of the pump piston, so that the possibility exists of establishing communication between the annular groove 54 and the suction chamber 7 upon each pump piston supply stroke. Via this communication, fuel accordingly leaks into the suction chamber 7, bypassing the fuel pumping to the respective fuel injection nozzle, so that the rate of pumping to the injection nozzle is reduced considerably. The effective supply stroke is determined by the position of the annular slide 18, and it ends whenever the first outlet openings are opened via the first control edge 19. Because of the resultant relief, the pressure in the pump piston work chamber 6 drops below the opening pressure of the injection valves, and the remaining fuel that has been pumped flows back into the suction chamber, with the area of the outlet cross section of the outlet openings 16 becoming increasingly more open. In connection with this mode of operation, FIG. 5 shows the development of the jacket face of a portion of the inner bore 53 of the annular slide, with the jacket face and the control openings of the pump piston contained there in the vicinity of the annular slide superimposed on it. A first position is visible in the drawing, at which the second outlet opening 52 is just touching the lower limiting edge 61 of the annular slide 54. The associated longitudinal conduit 55 is in complete coincidence with the annular groove, and at its left-hand end the control opening 58 is in complete coincidence with the longitudinal conduit or longitudinal groove 55. The first outlet openings are fully closed by the jacket face of the annular slide and have not yet reached the first control edge 19. In the second position, the pump piston has now risen farther and in so doing has rotated farther in the direction of rotation—that is, toward the right-hand side of the page as seen in FIG. 5. The second outlet opening 52' in this position is in coincidence with the annular groove 54, while the longitudinal groove 55' is still in coincidence with the annular groove and with the control opening 58. The first outlet opening in position 16' continues to be covered. A leakage flow flows out to the suction chamber 7, and the injection rate is reduced by the amount of this leakage flow. From the third position at 16'' on, however, this outlet opening is opened by the first control edge, even though the longitudinal groove 55' is still in communication with the control opening 58 and the second outlet opening 52'' is still in communication with the annular groove 54. From this point on, the injection is ended.

If the fuel quantity injected here is not enough to supply the engine, then via the centrifugal force transducer 43 and the idling spring 29 the slide is displaced toward the pump work chamber, so that with identical pump piston control, in accordance with the piston elevation curve 79 shown in FIG. 5, the second outlet opening 52 does not come into communication with the annular groove 54 until a later point. A fuel supply following a fuel pre-stressing stroke lasts correspondingly longer, and is followed by the pumping to a reduced extent as shown in FIG. 6. There, the fuel injection quantity, or rate, is shown over the stroke of the annular slide. The large rectangle on the left, up to point sv, is the quantity pumped by the pump piston that is necessary to pre-stress the fuel in the work chamber to the injection pressure. For the first case described above, this is followed, under the influence of the leakage, by a stroke hl at a reduced fuel injection rate until the useful stroke hn, which at the same time is equivalent to the stroke at full load VL. At the same time, this is the end of the stroke during idling operation with the quiet-idle device LV switched on. Contrarily, if the annular slide is moved out of this low load position into a higher load position, as has just been described above, then the stroke sx, at which the pump piston operates at the full supply rate, lengths from sv as far as line 2, or sx'. Pumping with a reduced quantity then extends as far as hn'. From the difference between the two supply rates, the overall result is an increased quantity of injected fuel. If there is a further load takeup, or if the load on the engine increases, the annular slide continues to be displaced toward the pump work chamber, so that leakage cannot be attianed until the line 5, for instance, or from the stroke sx'' on. Correspondingly, the supply stroke is ended at hn'', which is the pump piston supply stroke for the increased starting quantity. From this, it will be appreciated that in this manner, a load take-up at the full injection rate up to the level of the useful stroke hn is possible. Depending on how this useful stroke hn is structurally laid out, the injection quantity can be increased, from an operation in which a leakage of fuel takes place, up to quantities that for instance are equivalent to the full-load injection quantity.

In FIG. 5, the piston element curve 79 is shown at the injection timing point of 0°. However, if with increasing rpm the injection onset is shifted to earlier angles, up to 12° of camshaft angle toward the left in FIG. 5, then the opening cross sections 55, 52 and 16 can be imagined as shifted to the left, with the control cross section 58 remaining stationary. The shutoff device has the advantage here that for shutoff, it can be rotated in the opposite direction from this shift toward "early" of the opening process. If it is assumed that a leakage duration of approximately 10° of camshaft angle is required for quiet idling, then the shutoff rotation is reduced to this angle, plus the required coincidence, in order to obtain a tight closure between the control opening and the longitudinal groove. The shutoff movement can accordingly be kept very short in length, so that the entire device is also usable in a fuel injection pump that supplies more than four cylinders with fuel per pump piston rotation.

In order to pass from the operating position 58 shown in FIG. 5 to the shutoff position 58', the control lever 74 is adjusted accordingly. The control lever 74 is coupled to the adjusting lever 35 and moved by it such that at load takeup or at a transition from idling to partial-load operation, the control lever moves the control opening 58' into the shutoff position. The result is an automatic shutoff at load takeup, associated with a gentle transition in the fuel quantity metering, without a load jump.

To reduce the leakage path, it is also possible, instead of increasing the fuel quantity as described above, to rotate the annular slide upon the load takeup; in principle, the same fuel quantity control as shown in FIG. 6 for the load takeup is obtained, which is achieved by raising the annular slide.

Figure 3:
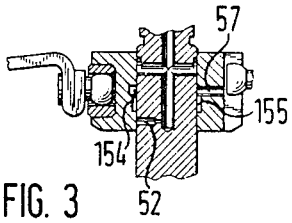
FIG. 3 shows an equivalent of the exemplary embodiment of FIG. 2.

An embodiment shown in FIG. 3 that is equivalent to the embodiment of the invention shown in FIG. 2 is also possible. Here the longitudinal grooves 155 that embody the longitudinal conduits are shifted into the jacket face of the inner bore 153. The annular groove 54 provided in the exemplary embodiment of FIG. 2 is then, in the form of an annular groove 154, located at the pump work chamber end of the longitudinal grooves 155 and commucicates continuously with the radial conduit 57. The other openings are disposed in the same manner as in the exemplary embodiment of FIG. 2. in this embodiment, the second outlet opening 52, in cooperation with the longitudinal conduits 155, serves as a control opening, analogously to the above-described mode of functional relationship between the longitudinal conduits 55 and the control opening 58. In this case, for the load takeup or for controlling the relief quantity, an adjustment of the rotational angle of the annular slide, which at the same time also takes on the shutoff function, can be made.

Figure 8:
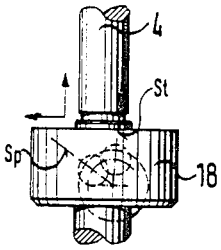
FIG. 8 is an illustration of the rotational slide movement, or of the position of the control device actuating it, in various operating ranges, for the exemplary embodiment of FIG. 7.
Figure 7:
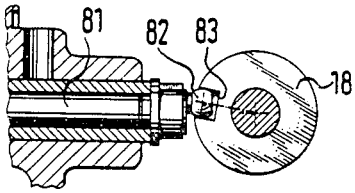
FIG. 7 shows a second exemplary embodiment of the invention, in a modification of the exemplary embodiment of FIG. 1, in the form of a fragmentary cross section through a fuel injection pump.

A second exemplary embodiment of the invention is shown in detail in FIG. 7. Instead of the mechanical regulator or governor; for adjusting the annular slide 18, a rotary magnet final control element, known per se, is provided, only the control shaft 81 to which the magnetic final control element is mounted is shown. Disposed on its other end is an actuation element in the form of a ball head 82 seated eccentrically on the face end of the control shaft 81. This ball head engages a recess 83 of circular cross section on the circumference of the annular slide 18, and the recess 83 is adapted to the shape of the ball head such that play-free actuation is possible. Deviating from the exemplary embodiment of FIG. 1, this ball head 82 also replaces the sliding element 65 of FIG. 2. In other words, a separate torque device for the annular slide is not provided. In FIG. 8, a plan view on the annular slide 18 is provided, showing a starting position St of the ball head 82 and a stop position Sp of the ball head. It will be appreciated that here, as in FIG. 7, the axis of the control shaft 81 is located beside the longitudinal axis of the pump piston.

Figure 9:
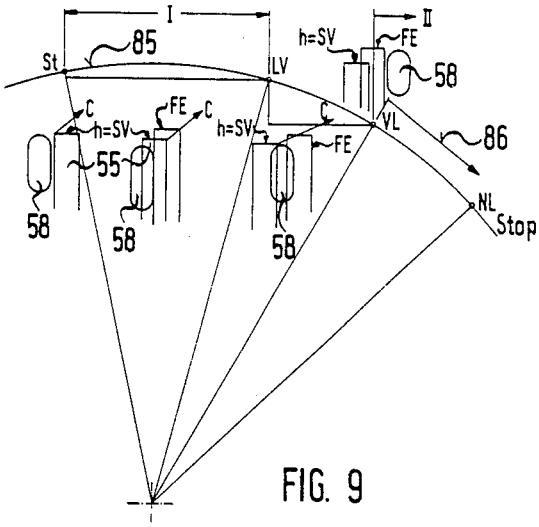
FIG. 9 is an adjustment diagram for the adjusting device of the exemplary embodiment of FIG. 7.

FIG. 9 shows the mode of operation of this embodiment. The operating range of the rotary magnet final control element is divided into two different operating ranges. The first operating range I is located on the divided circle 85 of the circle of motion which is the circle described as it is moved by the ball head 82, which is oriented toward the pump work chamber. This range is located approximately symmetrically with respect to an axis that extends parallel to the pump piston axis and intersects the axis of the control shaft 81. Along this divided circle 85, the ball head 82 substantailly executes a movement in the circuferential direction of the annular slide. The axial motion of the annular slide here is negligibly small. The shutoff movement of the annular slide takes place in this first operating range. The non-shut-off quiet idling is shown at LV on the right end of the operating range I, while in the left end range the quiet quiet-idle device is shut off, and at the same time the starting injection quantity is switched on. This position is indicated as St. Below LV and St and in the axial center, some associations of the control cross section 58 with one of the longitudinal conduits 55 are shown, each at the stroke onset after the execution of the pre-stressing stroke sv. In this process the longitudinal conduit 55 shown moves in the same direction each time, as shown in FIG. 5, or in other words rotating clockwise with a simultaneously occuring stroke movement as indicated by the arrow c. In the position LV, in the outset position after the execution of a stroke sv in which the second outlet opening 52 comes into communication with the annular groove 54, the longitudinal conduit 55 is already in coincidence with the left edge of the control opening 58. At the end of the supply stroke, the longitudinal conduit 55 is still in coincidence with the control opening 58, this time on its right side. Following the shutoff movement, it in time, that is, comes afterward, or physically, by tracking along with the opening, in the middle range, after the execution of the pre-stroke sv, the longitudinal conduit 55 is in coincidence with the right half of the control opening 58. This coincidence is maintained over a partial stroke that becomes shorter in accordance with how much farther the annular slide is rotated in the shutoff direction toward the position St. In the position St, finally, after the execution of the pre-stroke sv, the longitudinal conduit is no longer in coincidence with the control opening 58.

Figure 10:
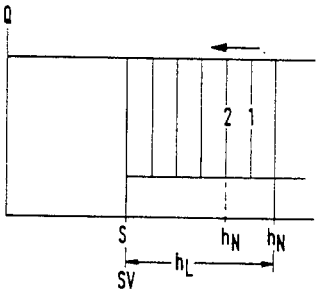
FIG. 10 is a diagram of the fuel quantity attaining injection over the stroke of the pump piston, at various degrees of shutoff of the quiet-idle device.

This embodiment has the advantage that during the pre-stroke sv, the fuel is pre-stressed with the maximum possible supply rate, analogously to FIG. 6 and as now shown in FIG. 10. This is followed, as viewed for the position LV over the stroke length $h_L$, which is the leakage path, by a supply stroke at which the supply rate is reduced substantially. This corresponds to the flatter lower rectangle along the abscissa in FIG. 10. If load is now taken up beginning at the position LV, then with increasing rotation toward the left, at the end of the supply stroke, increasingly wide supply segments, (lengths of time during which supply takes place) in which supply is effected at full pumping output, after an initially reduced supply rate. For example, for a setting position 2, which in principle is equivalent to the setting position 2 in FIG. 2, pumping is done at a reduced supply rate, after execution of the pre-stroke length sv to the stroke hn', and from stroke hn' to hn again at full pumping output. This means that in the present case, the injection event is adapted to the actual requirement of the engine. During the injection onset, pumping is done at a low supply rate, so that during the ignition delay excessively large quantities of fuel will not be pre-stored in the combustion chamber, and only toward the end of the supply stroke is the supply rate then increased.

The second operating range II of the magnetic final control element encompasses the normal operation of the engine, in which injection takes place without a quiet-idle device, that is, without leakage of fuel or without a reduced fuel injection rate. Here an arc 86 of the circular path of the ball head 82 comes into effect; this arc laterally succeeds the first operating range I, after a certain intervening portion. This arc 86 has a substantially larger directional component in the axial direction, so that upon the rotation of the ball head 82, a substantial axial motion of the annular slide 18 can be effected as well. At the left end of the second operating range II, the annular slide is at its highest position, corresponding to the maximum fuel load injection quantity. This point is marked as VL. From the control cross section shown above it, it is apparent that at the beginning of the effective supply stroke or in other words after the execution of the prestroke length sv, the longitudinal conduit 55 is located on the left of the control cross section 58, and even after the total supply stroke has been executed does not come into communication with this control cross section. With increasing rotation of the annular slide toward the right, beginning at VL, toward lower load ranges, the control opening 58 becomes still more remote from the longitudinal conduits, so that in range II leakage is precluded completely. Along the arc path 86, by rotation of the ball head 82, the annular slide reaches positions corresponding to low load down to shutoff. Here the governor effects breakaway control in the usual manner.

The rotary magnet final control element, not shown in further detail here, is controlled by a regulating device that is likewise not shown or described further here; for the work performed in the operating ranges I and II, the ball head 82 can also be adjusted in large incremental jumps rather than gradually. With the aid of the electronic control unit, the annular slide is capable of assuming all possible and necessary positions. In the primary operating ranges, in idling with the quiet-idle device switched on, or with a reduced fuel injection rate, continuous operation is possible, and this is also true for operation under load, that is, in operating range II. At the transition from one range to another, contrarily, the magnetic final control element must execute large rotational movements.

In this embodiment, described in conjunction with FIGS. 7–10, accordingly only one bore for guiding the ball head 82 is necessary on the annular slide, instead of two grooves as in the exemplary embodiment of FIG. 1. It is also no longer necessary to provide a mechanical coupling of the control lever with the adjusting lever. For this purpose, a corresponding electronic control is provided. Nor are any modifications of the pump housing as compared with a standard model necessary, nor are any additional forces generated at the gas pedal. A steady transition from quiet-idling operating to the partial-load range is still possible, however, without having to proceed beyond the full-load quantity.

As compared with the prior art, the fuel injection pump according to the invention represents an improvement in function, with a much less structurally loaded pump piston, which in particular, because a second relief conduit is eliminated, can be made much more slender than a pump piston in the prior art. Moreover, there are no additional idle volumes in the high-pressure circuit, which would affect the accuracy of the injection quantity.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines, having a pump housing, a fuel relief chamber in said housing, a pump cylinder in said housing, a pump piston (4) driven for simultaneous reciprocation and rotation in said pump cylinder (3) which serves as a distributor of the pumped fuel seccessively to a plurality of injection locations, said pump piston defines with said pump cylinder a pump work chamber (6), a relief conduit extending from said work chamber to a first outlet opening (16) on the pump piston circumference leading to said relief chamber (7), an annular slide (18) that is axially displaceable on the pump piston (4) inside the relief chamber by a fuel injection quantity regulator (25) which varies control of a fuel injection quantity, said annular slide includes a first control edge (19), which is located in a radial plane to the pump piston axis, by way of which said first outlet opening (16) is controllable by said first control edge after a variable compression stroke of the pump piston, a radial conduit (50) which leads from the relief conduit (14) to a second outlet opening (52) on the pump piston circumference, in the vicinity of said annular slide (18), said annular slide (18) including a conduit (57) which communicates with said relief chamber for controlling the second control opening which discharges at its inner jacket face, an annular groove (54, 154) and longitudinal conduits (55, 155) formed and defined between the pump piston circumference and the inner jacket face of the annular slide, said conduits (55, 155) communicating with said annular groove (54, 154) and, beyond an initial stroke (sx) of the pump piston (4) corresponding to a load-dependent axial position of said annular slide (18) communicating with said second outlet opening (52) and, during a rotational angle defined by a duration of coincidence of one of said longitudinal conduits (55) with a control opening (58; 62), connecting said radial conduit (50) with said conduit (57) to establish a communication via a limiting throttle between the pump piston work chamber (6) and the relief chamber (7).

2. A fuel injection pump as defined by claim 1, in which said annular slide (18) is rotatable by a torque device (65, 68; 82, 81), and in this process the duration of the communication of the control opening with the respective longitudinal groove (55) is adjustable.

3. A fuel injection pump as defined by claim 2, in which said control opening (58) is the outlet opening (58) of the conduit (57) which discharges at the inner jacket face of the annular slide (18), and said longitudinal conduits are longitudinal grooves (55) in the jacket face of the pump piston, and said second outlet opening (52) comes into communication with the annular groove (54) after an initial stroke (sx) of said piston.

4. A fuel injection pump as defined by claim 2, in which said control opening is the second outlet opening (52) on the pump piston, and the longitudinal couduits are disposed as longitudinal grooves (155) on the inner jacket face of the annular slide and discharge on an end toward the pump work chamber into the annular groove (154), which in turn communicates continuously with the conduit (57).

5. A fuel injection pump as defined by claim 3, in which an axial distance (h2) between a limiting edge (61), of the annular groove of the annular slide on the side toward the pump piston drive and the first control edge (19) is larger by the length of a leakage path ($h_L$) than the axial distance (h1) between the second outlet opening (52) and the first outlet opening (16).

6. A fuel injection pump as defined by claim 4, in which the axial distance between the limiting edge of the longitudinal conduits (155) and the first control edge (19) on the side toward the pump piston drive is larger by the length of a leakage path ($h_L$) than the axial distance between the second outlet opening (52) and the first outlet opening (16).

7. A fuel injection pump as defined by claim 4, in which upon attainment of a relief stroke (sx, sv), the control edge of the second outlet opening (52) comes into communication, as a function of the rotational angle of said annular slide with the respective longitudinal conduit (55), and after a leakage stroke ($h_L$), the first outlet opening (16) reaches the first control edge (19).

8. A fuel injection pump as defined by claim 2, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly, and said adjusting lever (35) is coupled with a torque device (65) of said annular slide.

9. A fuel injection pump as defined by claim 3, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly, and said adjusting lever (35) is coupled with a torque device (65) of said annular slide.

10. A fuel injection pump as defined by claim 4, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly, and said adjusting lever (35) is coupled with a torque device (65) of said annular slide.

11. A fuel injection pump as defined by claim 5, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly and said adjusting lever (35) is coupled with a torque device (65) of said annular slide.

12. A fuel injection pump as defined by claim 6, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly, and said adjusting lever (35) is coupled with a torque device (65) of said annular slide.

13. A fuel injection pump as defined by claim 7, in which said fuel injection quantity regulator (25) has an rpm transducer (43), which counter to the force of a governor spring assembly (42, 29, 28) adjusts the axial position of the annular slide (18) via a governor lever (39), and has an adjusting lever (35) via which the load of said governor lever (39) is arbitrarily variable by said governor spring assembly, and said adjusting lever (35) is coupled with a torque device (65) of said annular slide.

14. A fuel injection pump as defined by claim 8, in which a first coupling device between the annular slide (18) and the governor lever (39), allows a rotational movement of the first control edge without an axial change, said first coupling devices comprises guide faces (41) located in a radial plane to the pump piston axis and a sliding element (40) which slides on these guide faces, a second coupling device between the annular slide (18) and a pivot device (65, 66) of the torque device, which allows an axial movement without rotation of the annular slide, said second coupling device comprises guide faces (63), located in a direction toward the pump piston axis and oriented in a circumferential direction of the pump piston, and a sliding element (65) guided on these guide faces.

15. A fuel injection pump as defined by claim 8, in which said adjusting lever (35), at a position corresponding to the beginning of the partial load range at load takeup, has moved the annular slide into a rotational position at which the communication between the pump work chamber and the relief chamber (7) via the control opening is continuously closed over the entire pump piston supply stroke.

16. A fuel injection pump as defined by claim 14, in which said adjusting lever (35), at a position corresponding to the beginning of the partial load range at load takeup, has moved the annular slide into a rotational position at which the communication between the pump work chamber and the relief chamber (7) via the control opening is continuously closed over the entire pump piston supply stroke.

17. A fuel injection pump as defined by claim 2, in which a rotation of said annular slide is actuated at the same time as its axial adjustment by means of the fuel injection quantity regulator.

18. A fuel injection pump as defined by claim 17, in which said fuel injection quantity regulator is a rotary magnet final control element having a shaft (81) on an end on which a spherical actuating element (82) is eccentrically mounted, and said spherical actuating element (82) fittingly engages a recess (83) on the annular slide.

19. A fuel injection pump as defined by claim 18, in which said rotary magnet final control device, controlled by a regulating device controls the annular slide, in order to effect a change in a duration of coincidence of the respective longitudinal conduit (55) with the control opening, is adjusted in a first operating range (I), in which the actuating element (82) is moved over an arc extending in a circumferential direction of the annular slide (18), substantially in a plane radial to the pump piston axis, and for a change in the setting of the fuel injection quantity in the partial-load range to the full-load range is adjusted in a second operating range (II), in which the actuating element (82) is moved over an arc that adjoins the divided circle of the first operating range and extends substantially in an axial direction of the pump piston, and within the second operating range (II) the longitudinal conduits (55) remain continuously separated from the control opening (58).

20. A fuel injection pump as defined by claim 13, in which said control opening is associated in such a way with the longitudinal conduit (55) that a shutoff movement of the annular slide (18) is effected in the first operating range (I) counter to the rotational direction of the pump piston, and a breakaway control movement of the annular slide for reducing the quantity of fuel injected per pump piston stroke is effected with its circumferential component, within the second operating range (II) in the rotational direction of the pump piston.

21. A fuel injection pump as defined by claim 20, in which a change in the injection quantity in the first operating range (I) takes place by means of a change in a distribution between a full supply portion and a quiet-idling supply portion, and the full supply portion builds up from the end of injection and takes place in the second operating range (II) by means of changing the end of supply (FE).

* * * * *